United States Patent [19]

Lange

[11] Patent Number: 4,580,735

[45] Date of Patent: Apr. 8, 1986

[54] SIZE-REDUCTION APPARATUS, ESPECIALLY FOR TWIGS AND BRANCHES OF TREES AND SHRUBBERY

[75] Inventor: Ulrich Lange, Oberrot, Fed. Rep. of Germany

[73] Assignee: AS-Motor Gesellschaft mit beschränkter Haftung u. Co. K.G., Oberrot, Fed. Rep. of Germany

[21] Appl. No.: 599,506

[22] Filed: Apr. 12, 1984

[30] Foreign Application Priority Data

Apr. 16, 1983 [DE] Fed. Rep. of Germany ..... 8311394

[51] Int. Cl.[4] ..... B02C 18/10

[52] U.S. Cl. ..... 241/101.7; 241/151

[58] Field of Search ..... 241/101 D, 151, 101.7, 241/282.1, 282.2, 134, 138, 139–146

[56] References Cited

U.S. PATENT DOCUMENTS 989,217 4/1911 Wear ..... 241/146 X
1,555,463 9/1925 Ely ..... 241/142 X
3,608,838 9/1971 Lundin ..... 241/101.7 X
4,360,166 11/1982 Biersack ..... 241/101.7 X
4,477,029 10/1984 Green ..... 241/282.2 X

FOREIGN PATENT DOCUMENTS 633066 7/1936 Fed. Rep. of Germany ..... 241/138

*Primary Examiner*—Mark Rosenbaum
*Attorney, Agent, or Firm*—Becker & Becker, Inc.

[57] ABSTRACT

A size-reduction apparatus, especially for twigs and branches of trees and shrubbery is disclosed. The apparatus is provided with a loading chute, a chopping chamber having a chopping blade which rotates about a vertical axis, a shredding chamber having a cutting blade which rotates about a vertical axis, a feed tube which opens into the shredding chamber, a drive motor, and a respective discharge chute or conduit for each of the shredding and chopping chambers. The chopping blade and the cutting blade are driven separately by a respective shaft, and the chopping chamber and the shredding chamber are disposed next to one another.

8 Claims, 2 Drawing Figures

SIZE-REDUCTION APPARATUS, ESPECIALLY FOR TWIGS AND BRANCHES OF TREES AND SHRUBBERY

BACKGROUND OF THE INVENTION

1. Field of the Invention

The present invention relates to a size-reduction or shredding apparatus, especially for twigs and branches of trees and shrubbery; the apparatus is provided with a loading chute, a chopping chamber having a chopping blade which rotates about a verical axis, a shredding chamber having a cutting blade which rotates about a vertical axis, a feed tube which opens into the shredding chamber, a drive motor, and a respective discharge conduit or chute for each of the chopping and shredding chambers.

2. Description of the Prior Art

Pursuant to one known apparatus of this general type, the chopping blade and the shredding blade are both secured on the same vertical shaft. The chopping chamber and the shredding chamber are therefore disposed one above the other, with the shredding chamber and its cutting blade being provided directly below the chopping chamber. The discharge conduits for the chopping chamber and for the shredding chamber open into a common discharge chute, the discharge opening of which is only a small distance from the ground, so that only a relatively small receptacle can be placed below the shoot for receiving the chopped and shredded material. Thus, the receptacle has a correspondingly small holding capacity, so that in a short period of time it is filled to such an extent that the chute can become clogged. A further drawback is that cleaning and servicing the chopping and shredding chambers, which are disposed one above the other, is difficult due to the poor accessibility. Yet another drawback is that the apparatus must be taken apart in order to replace the cutting blade.

It is therefore an object of the present invention to design a size-reduction apparatus in such a way that not only is better accessibility to the operating parts assured, but a trouble-free operation is also assured.

BRIEF DESCRIPTION OF THE DRAWING

This object, and other objects and advantages of the present invention, will appear more clearly from the following specification in conjunction with the accompanying drawing, in which.

SUMMARY OF THE INVENTION

Figure 1:
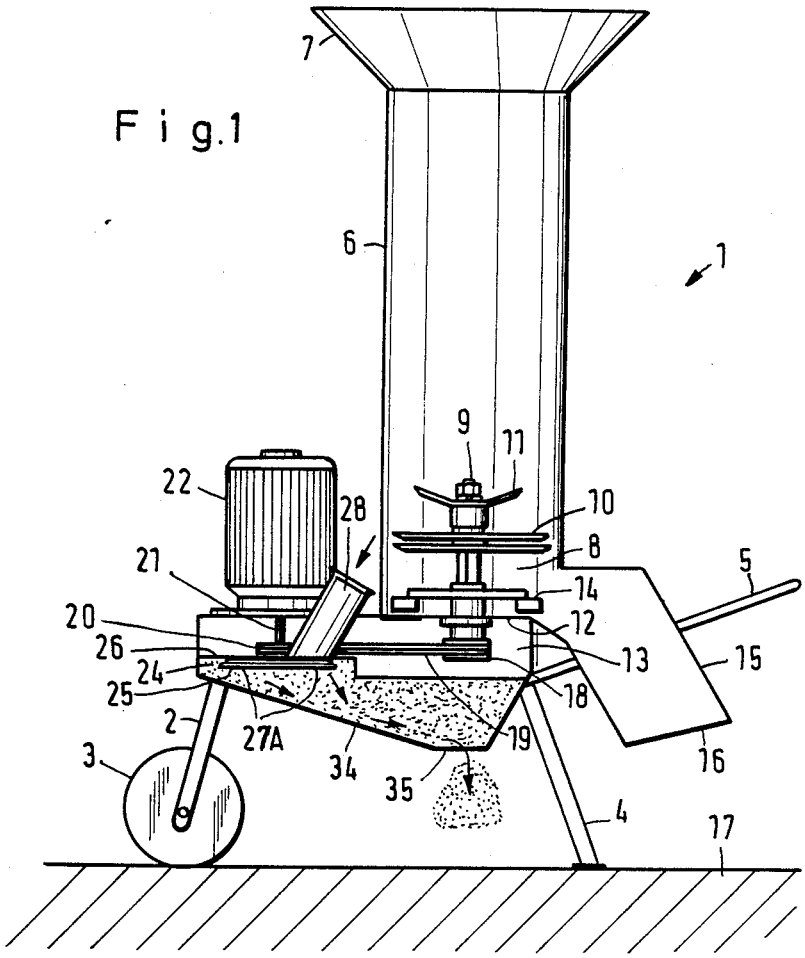
FIG. 1 is a schematic, partially sectioned side view of one embodiment of the inventive apparatus.

The size-reduction apparatus of the present invention is characterized primarily in that the chopping blade and the cutting blade are driven separately by a respective shaft, and in that chopping chamber and the shredding chamber are disposed next to one another.

As a result of this arrangement, the blades on the two shafts are individually accessible, and the two chambers can be cleaned without difficulty.

Pursuant to preferred specific embodiments and further features, as well as further advantages and important details, of the present invention, the shaft of the cutting blade and the shaft of the chopping blade can be coupled by a drive unit. This drive unit may comprise belt pulleys disposed on the shaft of the cutting blade and on the shaft of the chopping blade, as well as at least one V belt. The V belt and the belt pulleys may be disposed in a drive unit compartment which is located in the region below the chopping chamber and above the shredding chamber. The drive motor may be disposed in the region above the shredding chamber and in the front portion of the apparatus. The cutting blade may be driven directly from the motor shaft of the drive motor.

The drive motor may be disposed on a cover of the drive unit compartment, and the motor shaft may pass through the drive unit compartment and a guard which shields the shredding chamber and which is disposed between the belt pulley and the cutting blade. The cutting blade may be disposed at a slight distance below the guard of the shredding chamber.

The branch feed tube may open at an angle from above into the guard of the shredding chamber next to the belt pulley which is seated on the motor shaft. The feed tube may have an oblong cross-sectional area which has two long sides and two narrow sides.

The narrow sides of the cross-sectional area of the feed tube may be constructed as circular arcs; at least one crossbar may be disposed in the region of the inlet opening of the feed tube between the two long sides thereof.

A discharge chute which extends from the shredding chamber toward the back may be provided below the drive unit compartment; the outlet opening of this discharge chute may be disposed approximately below the shaft of the chopping blade in the region between the front wheel and the rear supporting legs of the apparatus support, which is embodied in the manner of a wheelbarrow. The outlet openings of the discharge chute of the shredding chamber, and of the discharge conduit of the chopping chamber, may be disposed at approximately the same level and at a distance from the ground which corresponds at least to the height of a collecting receptacle.

An ejector may be secured on the shaft of the chopping blade just above the bottom of the chopping chamber. A preliminary chopper may be disposed on that end of the shaft of the chopping blade remote from the belt pulley, and approximately at the level of the top of the drive motor.

DESCRIPTION OF PREFERRED EMBODIMENTS

Referring now to the drawing in detail, the size reduction or shredding apparatus 1 can be manually handled by a single operator in a manner similar to a wheelbarrow, and serves to reduce the size of shred garden debris such as shrubbery, tree and hedge twigs, tree branches, and the like. The support 2 is provided with at least one front wheel 3, a rear supporting leg 4, and two rear handles 5. A tubular loading or filling chute 6 is arranged on the wheelbarrow-like support 2. The longitudinal axis of the loading chute 6 is disposed essentially vertically, and the upper end region of the chute 6 is provided with a funnel 7.

A chopping or shredding chamber 8 is provided in the lower portion of the loading chute 6. A chopping or shredding blade 10, which is constructed as a double blade and rotates in a horizontal plane, is secured in the chopping chamber 8 on a vertical shaft 9. Several blades also could be disposed one above the other. A preliminary chopper 11 is detachably secured above the chopping blade 10 on the upper end region of the shaft 9. The preliminary chopper 11 prebreaks or precuts the shrubbery and twigs supplied to it, so that the chopping blade 10 is not so severely stressed so severely. If necessary, due to the easy accessibility and the uncomplicated attachment, it is possible without difficulty to remove the chopping blade 10 and/or the preliminary chopper 11 from the shaft 9 and to replace them with new or sharpened components. An ejector 14 is secured to the shaft 9 below the chopping blade 10 in the lower region of the chopping chamber 8, and closely above the cover 12 of a drive unit compartment 13. A discharge conduit 15 is provided on the chute 6 in the vicinity of the ejector 14. The chopped-up material is discharged through the conduit 15 toward the back and downwardly at an incline. The discharge conduit 15 is located in the rear portion of the support 2 between the two handles 5, where the discharge opening 16 of the conduit 15 ends, with the distance of the opening 16 from the ground 17 being such that it is possible to attach a receptacle which has a large holding capacity.

The drive unit compartment 13 which is located below the chopping chamber 8 extends essentially horizontally toward the front and ends approximately in the vicinity above the front wheel 3. A twin belt pulley 18 is seated on the shaft 9, which passes through the cover 12, so that the lower end of the shaft 9 extends into the drive unit compartment 13. The twin belt pulley 18 is connected via V belts 19 with a twin belt pulley 20, which is disposed in the front region of the drive unit compartment 13 and is secured to the shaft 21 of the drive motor 22. This belt drive is disposed within the drive unit compartment 13. The drive motor 22 is located on the front of the support 2 in the region above the front wheel 3 and ahead of the loading chute 6. The motor 22 is secured to the cover 12 of the drive unit compartment 13. The motor shaft 21 passes through the cover 12. This arrangement of the drive motor 22 on the front portion of the support 2 results in a very advantageous distribution of weight, so that the apparatus is very stable in the illustrated upright position, and can be favorably handled and operated during transport in the manner of a wheelbarrow, since a considerable portion of the weight is disposed practically directly above the front wheel 3. It is therefore very easy to lift the apparatus via the handles 5, and the apparatus also can be easily operated with only little expenditure of energy.

Provided below the drive motor 22 and the drive unit compartment 13 is a shredding or cutting chamber 24 in which is located a horizontally rotating cutting or shredding blade 25, which is secured to the lower end of the vertical motor shaft 21. The shredding chamber 24 is shielded relative to the drive unit compartment 13 at the top by a cover or guard 26. The cutting blade 25 is expediently disposed at only a slight distance from the guard 26 of the chamber 24. As shown in FIG. 2, the blade 25 is partially recessed in a disk 27 and extends radially beyond the periphery thereof. The disk 27 is preferably in the form of a flywheel mass. Conveying vanes 27A (indicated schematically in FIG. 1) are disposed on the bottom side of the disk 27. These conveying vanes 27A can be embodied similar to fan blades, and impart a component of movement to the cut material which assists the discharge of the latter. The height of the disk 27 can be adjustable in order to vary the chip thickness of the cut material.

In order to supply to the inventive apparatus particularly thick branches having a diameter of up to 5 cm, a branch feed tube 28 is provided. The feed tube 28 ends in a plane above the cutting blade 25, and opens into the shredding chamber 24 in the vicinity of the guard 26. The feed tube 28 is inclined both toward the side and toward the back, and is located in the front part of the apparatus ahead of the loading chute 6 and next to the belt pulley 20 of the drive motor 22. In the illustrated embodiment, the feed tube 28 has an oblong cross-sectional area 29 which is defined by two parallel long sides 30 and two narrow sides 31, so that the central major axis of the cross-sectional area 29, which axis extends parallel between the long sides 30, is greater than the intersecting transverse axis of the somewhat rectangular cross-sectional area 29. The cross-sectional area can be rectangular, but in the illustrated embodiment the narrow sides 31 are curved in a partial cylindrical manner. Elliptical or oval cross-sectional areas can also be utilized. The important thing is that the tube 28 have as large an inside width as possible in order to be able to accommodate curved and heavily branched wood; furthermore, for safety reasons, the tube 28 should be embodied such that it can only receive branches and twigs having a certain maximum diameter which, pursuant to the existing safety codes, is limited to 5 cm. In order to achieve this, two parallel cross bars 33 are fixed between the two long sides 30 of the cross-sectional area 29 in the vicinity of the inlet opening 32 of the feed tube 28. In this way, the usable area of the inlet opening 32 is restricted to the previously specified dimension, so that only those branches can be introduced, the diameter of which does not exceed the specified dimension. Due to the large interior space of the feed tube 28, however, curved branches can also be introduced without difficulty despite the narrow inlet opening; during insertion, the curved branches are then turned in conformity with their shape. It is just as easy to introduce branched shrubbery, which during insertion is elastically compressed next to and between the cross bars 33, and which immediately expands in the roomy tube 28. Without jamming in the tube 28, the inserted branches, twigs, and shrubbery debris can also easily fall or slide to the bottom, and reliably reach the cutting mechanism.

Figure 2:
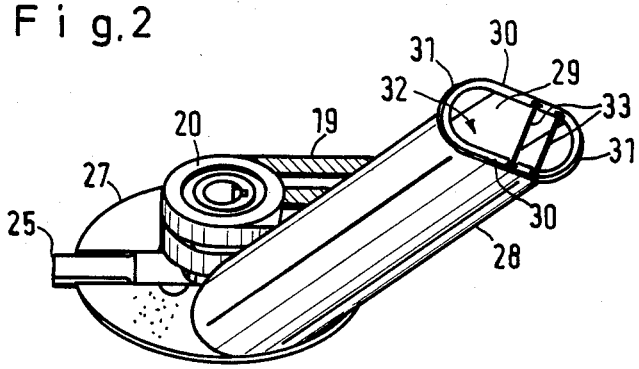
FIG. 2 is a partial plan view of the shredding region of the apparatus of FIG. 1.

As can be seen in FIG. 1, a discharge chute 34 is provided in the region below the drive unit compartment 13; the discharge chute 34 has inclined side walls and extends toward the back from the shredding chamber 24. The outlet opening 35 of this funnel-like discharge chute 34 is disposed coaxially below the shaft 9 of the chopping chamber 8 in the region between the front wheel 3 and the rear supporting legs 4. The discharge chute 34 and the discharge conduit 15 of the chopping chamber 8 are disposed in such a way that their outlet openings are at approximately the same level above the ground 17. The distance from the ground 17 is such that a higher collecting receptacle having a larger holding capacity for the shredded and chopped material can be placed below the chute 34 and also below the conduit 15.

The present invention is, of course, in no way restricted to the specific disclosure of the specification and drawing, but also encompasses any modifications within the scope of the appended claims.

What I claim is:

1. In a shredding apparatus especially for twigs and branches of trees and shrubbery, including:

a support;
a loading chute disposed on said support;
a chopping chamber provided in said loading chute;
a discharge conduit which communicates with said chopping chamber respectively; the improvement in combination therewith comprising:
a first shaft disposed in said loading chute in a substantially vertical orientation when said apparatus is in an upright position;
a chopping blade arrangement drivingly and rotatably mounted on said first shaft in said chopping chamber;
a shredding chamber disposed separately although adjacent to one side of said chopping chamber;
a discharge chute which communicates with said shredding chamber respectively;
a second shaft disposed in said shredding chamber in a substantially vertical orientation when said apparatus is in an upright position;
a cutting blade arrangement drivingly and rotatably mounted on said second shaft in said shredding chamber;
an inclined feed tube which opens into said shredding chamber for twigs and branches of trees and shrubbery;
a single drive motor operatively connected with said first shaft and also with said second shaft respectively for driving same, said chopping and shredding chambers respectively having separate discharge openings respectively having less material coming therefrom respectively to avoid blockage, plugging and adherence of discharging material therein; and
a drive unit for coupling said first shaft and said second shaft, and for effecting said operative connection of said drive motor with said first and second shafts; said apparatus, when viewed in an upright position, having a front part and a back part, with said drive motor being disposed in said front part of said apparatus above said shredding chamber; said drive motor being provided with a motor shaft, which forms said second shaft and directly drives said cutting blade arrangement; said discharge chute extending from said shredding chamber toward said back part of said apparatus; said support being embodied in the manner of a wheelbarrow, having a front wheel in said front part of said apparatus, and supporting legs in said back part of said apparatus; said discharge chute being provided with an outlet opening remote from where it communicates with said shredding chamber, said outlet opening being disposed approximately below said first shaft and in the region between said front wheel and said back supporting legs; said discharge conduit being provided with a discharge opening; said discharge opening of said discharge conduit, and said outlet opening of said discharge chute, being disposed at approximately the same level above the ground and at a distance therefrom sufficient to permit introduction of a collecting receptacle below said openings.

2. An apparatus in combination according to claim 1, in which said drive unit comprises: a first belt pulley mounted on said first shaft; a second belt pulley mounted on said second shaft; and at least one V belt disposed about said first and second belt pulleys.

3. An apparatus in combination according to claim 2, which includes a drive unit compartment which, when said apparatus is in an upright position, is disposed in the region below said chopping chamber and above shredding chamber; said first and second belt pulleys, and said at least one V-belt, are disposed in said drive unit compartment.

4. An apparatus in combination according to claim 3, in which said drive unit compartment is provided with a cover, and said shredding chamber is shielded by a guard which is disposed between said second belt pulley and said cutting blade arrangement; said drive motor is disposed on said cover of said drive unit compartment, and said motor shaft passes through said drive unit compartment and said guard of said shredding chamber.

5. An apparatus in combination according to claim 4, in which said cutting blade arrangement is disposed at a slight distance below said guard of said shredding chamber.

6. An apparatus in combination according to claim 5, in which said feed tube opens from above, at an angle, into said guard of said shredding chamber next to said second belt pulley, which is seated on said motor shaft; said feed tube is provided with an oblong cross-sectional area having two long sides and two short sides.

7. An apparatus in combination according to claim 6, in which said short sides of said feed tube are in the form of circular arcs; in which said feed tube includes an inlet opening remote from where it opens into said shredding chamber; and in which at least one cross bar extends between said two long sides of said feed tube near said inlet opening thereof.

8. An apparatus in combination according to claim 1, which includes an ejector mounted on said first shaft just above said cover of said drive unit compartment, said cover forming the bottom of said chopping chamber; and which includes a preliminary chopper mounted on that end of said first shaft remote from said first belt pulley, said preliminary chopper being disposed approximately at the level of the top of said drive motor.

* * * * *